US006529544B2

(12) United States Patent
Ashburn

(10) Patent No.: US 6,529,544 B2
(45) Date of Patent: Mar. 4, 2003

(54) VACUUM HEAT TREATING FURNACE

(75) Inventor: Lennie L. Ashburn, 93 Pebble Valley Dr., Doylestown, PA (US) 18901

(73) Assignee: Lennie L. Ashburn, Mount Laurel, NJ (US)

( * ) Notice: Subject to any disclaimer, the term of this patent is extended or adjusted under 35 U.S.C. 154(b) by 0 days.

(21) Appl. No.: 09/988,927

(22) Filed: Nov. 19, 2001

(65) Prior Publication Data

US 2002/0126729 A1 Sep. 12, 2002

Related U.S. Application Data

(62) Division of application No. 09/802,330, filed on Mar. 8, 2001, now Pat. No. 6,349,108.

(51) Int. Cl.[7] ..... H05B 3/00
(52) U.S. Cl. ..... 373/109; 219/399
(58) Field of Search ..... 373/3, 5, 109–112, 373/117–119, 120, 122, 127, 128, 130, 131, 134; 219/390, 399, 406, 420, 424, 552

(56) References Cited

U.S. PATENT DOCUMENTS

| | | | | |
|---|---|---|---|---|
| 1,706,010 | A | 3/1929 | Walker | 373/134 |
| 2,557,530 | A | 6/1951 | Bancroft | |
| 2,896,004 | A | 7/1959 | Duffy et al. | 373/134 |
| 3,017,262 | A | 1/1962 | Fegan | |
| 3,144,199 | A | 8/1964 | Ipsen | |
| 3,185,460 | A | 5/1965 | Mescher et al. | |
| 3,257,492 | A | 6/1966 | Westeren | |
| 3,368,022 | A | 2/1968 | Mescher et al. | |
| 3,438,618 | A | 4/1969 | Seelandt | |
| 3,984,614 | A | 10/1976 | Isaksson | |
| 4,056,678 | A | 11/1977 | Beall, III et al. | |
| 4,142,062 | A | 2/1979 | Wentworth | 373/134 |
| 4,147,888 | A | 4/1979 | Sato | 373/134 |
| 4,246,434 | A | 1/1981 | Gunther et al. | |
| 4,259,538 | A | 3/1981 | Jones | |
| 4,429,403 | A | 1/1984 | Hooper | 373/128 |
| 4,559,631 | A | 12/1985 | Moller | 373/130 |
| 4,612,651 | A | 9/1986 | Moller et al. | 373/130 |
| 4,856,022 | A | 8/1989 | Jones | 373/112 |
| 4,860,306 | A | 8/1989 | Gibb | 373/112 |
| 5,233,165 | A | 8/1993 | Maumus et al. | 219/539 |
| 5,251,231 | A | 10/1993 | Croker et al. | 373/109 |
| 5,267,257 | A | 11/1993 | Jhawar et al. | 373/110 |
| 5,497,394 | A | 3/1996 | Jhawar et al. | 373/130 |
| 5,524,020 | A | 6/1996 | Jhawar et al. | 373/110 |
| 5,912,080 | A | 6/1999 | Fiel et al. | 428/408 |
| 6,021,155 | A | 2/2000 | Jones | 373/130 |
| 6,023,487 | A | 2/2000 | Jones | 373/130 |
| 6,083,625 | A | 7/2000 | Fiel et al. | 428/408 |
| 6,349,108 | B1 * | 2/2002 | Ashburn | 373/110 |

* cited by examiner

*Primary Examiner*—Tu Ba Hoang
(74) *Attorney, Agent, or Firm*—Howson and Howson

(57) ABSTRACT

An electric resistance high temperature vacuum furnace having radiant heating units evenly spaced around the sides and ends of the furnace hot zone. Pairs of units are automatically regulated both radially and longitudinally according to the temperature required by the workload in the hot zone. The units each comprise parallel aligned elements electrically connected in series at their one ends. Each element has lengthwise surfaces angularly disposed from each other to form a beam structure of high section modulus for stiffness and resistance to sagging. Also, the angles of the element surfaces facing a heat-reflective assembly substantially enable all of the energy radiated toward the assembly to be reflected into the hot zone in addition to the direct radiation from the surfaces facing the hot zone. The furnace includes a re-circulating cooling system for rapid cooling of the furnace and workload. An inert cooling fluid bypasses the hot zone, passing instead around the outside of the heat assembly and through a heat exchanger until the circulated fluid temperature drops below the maximum tolerated by all component parts in the cooling system, after which the fluid passes directly through the hot zone.

10 Claims, 9 Drawing Sheets

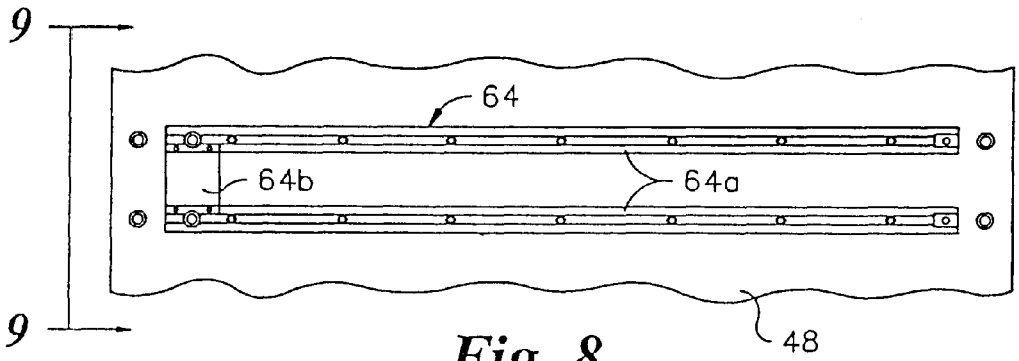
Fig. 8
Fig. 9
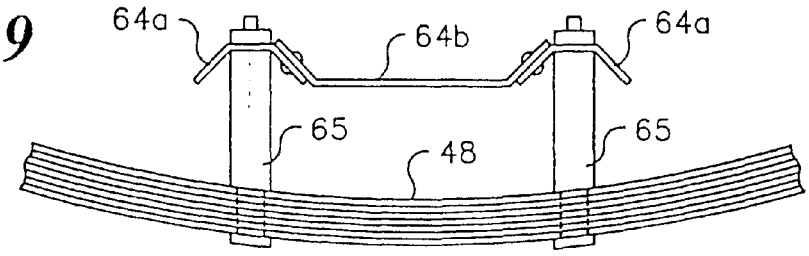
Fig. 10
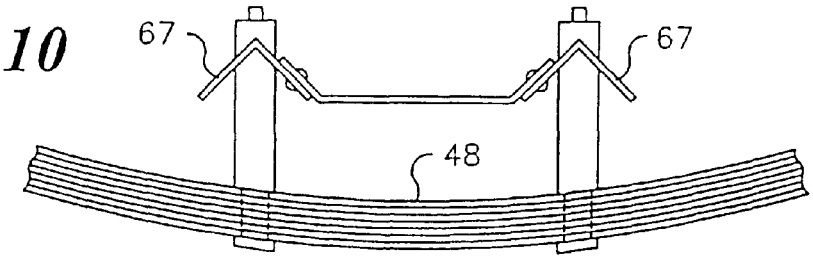
Fig. 9A
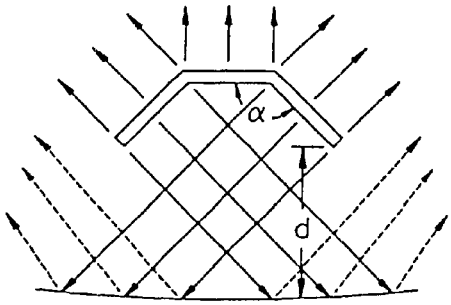
Fig. 10A
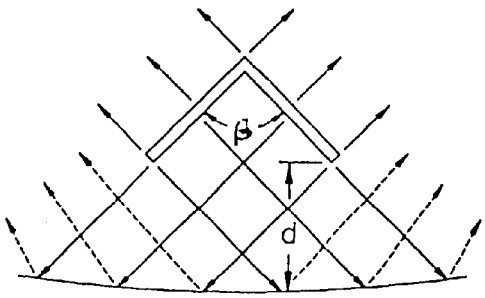

VACUUM HEAT TREATING FURNACE

CROSS-REFERENCE TO RELATED APPLICATION

This is a Divisional Application of U.S. patent application Ser. No. 09/802,330 filed Mar. 8, 2001, now U.S. Pat. No. 6,349,108.

BACKGROUND OF THE INVENTION

1. Field of the Invention

The present invention relates generally to electric resistance vacuum heat treating furnaces, and more particularly to improvements in a high temperature electric resistance vacuum furnace suitable for heat treating processes, such as brazing, tempering, degassing, sintering and hardening, in which the hot zone is heated by radiant energy and cooled by recirculated fluid.

2. Description of the Prior Art

Electric vacuum heat treating furnaces typically consist of a cylindrical water-cooled vessel containing heating elements forming a hot zone for receiving, a workload to be heat treated. An example of such a furnace is disclosed in U.S. Pat. No. 3,438,618 to Seelandt in which a cylindrical vessel contains a retort of separate upper and lower water-cooled, U-shaped shells with end walls movable into side-by-side relationship to form a box-like chamber. Radiant heating elements line each shell in transverse planes axially spaced along the length of the chamber. Additional elements in flat grids line both end walls. Multiple nested layers of radiant heat-reflecting shields reflect some of the radiation from the elements back into a hot zone work space. The furnace is evacuated by an oil diffusion pump to provide a non-oxidizing atmosphere during the heat treating process. A quenching fluid of inert gas may be injected into the chamber after the heating phase of the process is completed and recirculated through a heat exchanger for rapid cooling. U.S. Pat. No. 4,559,631 to Moller teaches annular banks of heating elements in planes axially spaced in the furnace. The banks of elements may be differentially located and/or energized to establish front-to-rear temperature trim zones. U.S. Pat. No. 3,185,460 to Mescher et al. and U.S. Pat. No. 3,257,492 to Westeren disclose elongate heating elements coaxially mounted in the furnace and mutually spaced from each other.

The heating elements are usually fabricated in flat bars of graphite or refractory metals such as commercially pure molybdenum in rectangular cross section as shown in Moller, supra., Seelandt, supra, proposed another element design which is elliptical in cross-section and of substantial thickness. The convex surfaces of the element face inwardly toward the middle of the chamber and outwardly toward the heat shields.

While prior art electric vacuum furnaces as above-described are satisfactory for many heat treating processes, they are lacking in certain design features which significantly improve efficiency in the process. Heating elements of thin rectangular or elliptical cross sections are prone to sag under high temperatures between spaced apart supports because of low section modulus. The rectangular and elliptical elements also inherently lack even distribution of emitted radiant energy from all surfaces for achieving the precision demanded. The radiant energy is emitted in opposite directions substantially perpendicular to the flat sides, consequently, energy directed toward a heat shield is merely reflected back to the element instead of onto the workload.

Elements with elliptical or similarly curved surfaces direct only a portion of the radiant energy emitted toward the heat shield for reflection onto the workload. The above-described heating element designs choke a significant percentage of the emitted radiant energy which reduces the effective surface area and results in higher element temperatures causing creep, sagging and non-uniform heating. Hence, the temperature of the workload will not be of optimal uniformity and a relatively long heat treating cycle time is required. When quenching fluid is recirculated in the furnace through a heat exchanger at completion of the heat treating phase, the extremely hot fluid returning to the heat exchanger may heat seals and other components therein beyond their design limits causing permanent damage and leakage.

SUMMARY OF THE INVENTION

Accordingly, it is a general object of the present invention to provide an electric resistance vacuum furnace suitable for heating a workload to high temperatures with better uniformity and for cooling the workload and furnace without damage to component parts of a recirculating cooling system.

Another object is to provide a high temperature vacuum furnace utilizing electric radiant energy heating elements of substantial stiffness with minimal cross sectional area that will not sag under high temperatures between horizontally spaced apart supports.

Still another object is to provide a furnace design for clean high vacuum operating conditions where heat is applied in a very uniform and controlled manner for heat treating processes such as brazing, tempering, degassing, sintering and hardening.

A further object is to provide an arrangement of heating elements which will efficiently disperse radiant energy from a high percentage of surfaces of the elements to a workload within the furnace.

Still another object is to provide an electric vacuum furnace wherein re-circulation of cooling fluid is regulated to prevent exposed temperature sensitive components from exceeding designed limits.

Still another object of the invention is to provide a furnace construction which meets the severe demands of the heat treating industry for precise temperature trim control during the heating phase of a process.

These and other objects, novel features, and advantages of the invention are accomplished in a high temperature vacuum furnace having a hot zone formed by longitudinally aligned matching parallel pairs of radiant energy heating units evenly spaced around the sides of the furnace starting with two adjacent pairs across the top, and opposed pairs continuing down the sides and two adjacent pairs across the bottom. Matching pairs of units at the front and back ends of the hot zone are arranged at multiple elevations. Each pair forms a trim zone which is automatically regulated both radially and longitudinally according to the temperature required by the workload in that zone. The units of each side pair comprise two parallel aligned resistance elements electrically connected in series at their one ends, and the units of each end pair comprise parallel aligned elements connected in series. Each element has lengthwise surfaces angularly disposed from each other to form a beam structure having a relatively high section modulus for stiffness and resistance to sagging. Also, the angles of the element surfaces facing a heat shield assembly effectively radiate a high percentage of the energy toward the assembly for reflection into the hot zone in addition to the direct radiation from the element surfaces facing the hot zone. The furnace includes a re-circulating cooling system for cooling of the furnace and workload in a controlled manner that reduces distortion of the workload. An inert gas cooling fluid bypasses the hot zone interior passing instead around the outside of the heat shield assembly and through a heat exchanger until the circulated fluid temperature drops below the maximum tolerated by all component parts in the cooling system, after which the fluid flow is modulated to pass directly through the hot zone interior.

The foregoing features and advantages of the invention will become more apparent from the following description when taken in conjunction with the accompanying drawings.

BRIEF DESCRIPTION OF THE DRAWINGS

FIG. 8 is a more detailed view within the furnace of a radiant energy heating unit according to the invention;

FIG. 9 is an end view of the heating unit of FIG. 8 taken along the line 9—9;

FIG. 9A diagrammatically illustrates the radiant energy emitted and reflected for an electrical resistance element in the heating unit of FIG. 9;

FIG. 10 is an end view like FIG. 9 of another embodiment of a radiant heating unit according to the invention;

FIG. 10A diagrammatically illustrates like FIG. 9A the radiant energy emitted and reflected for an electrical resistance element in the heating unit of FIG. 10.

DESCRIPTION OF THE PREFERRED EMBODIMENTS

Figure 1:
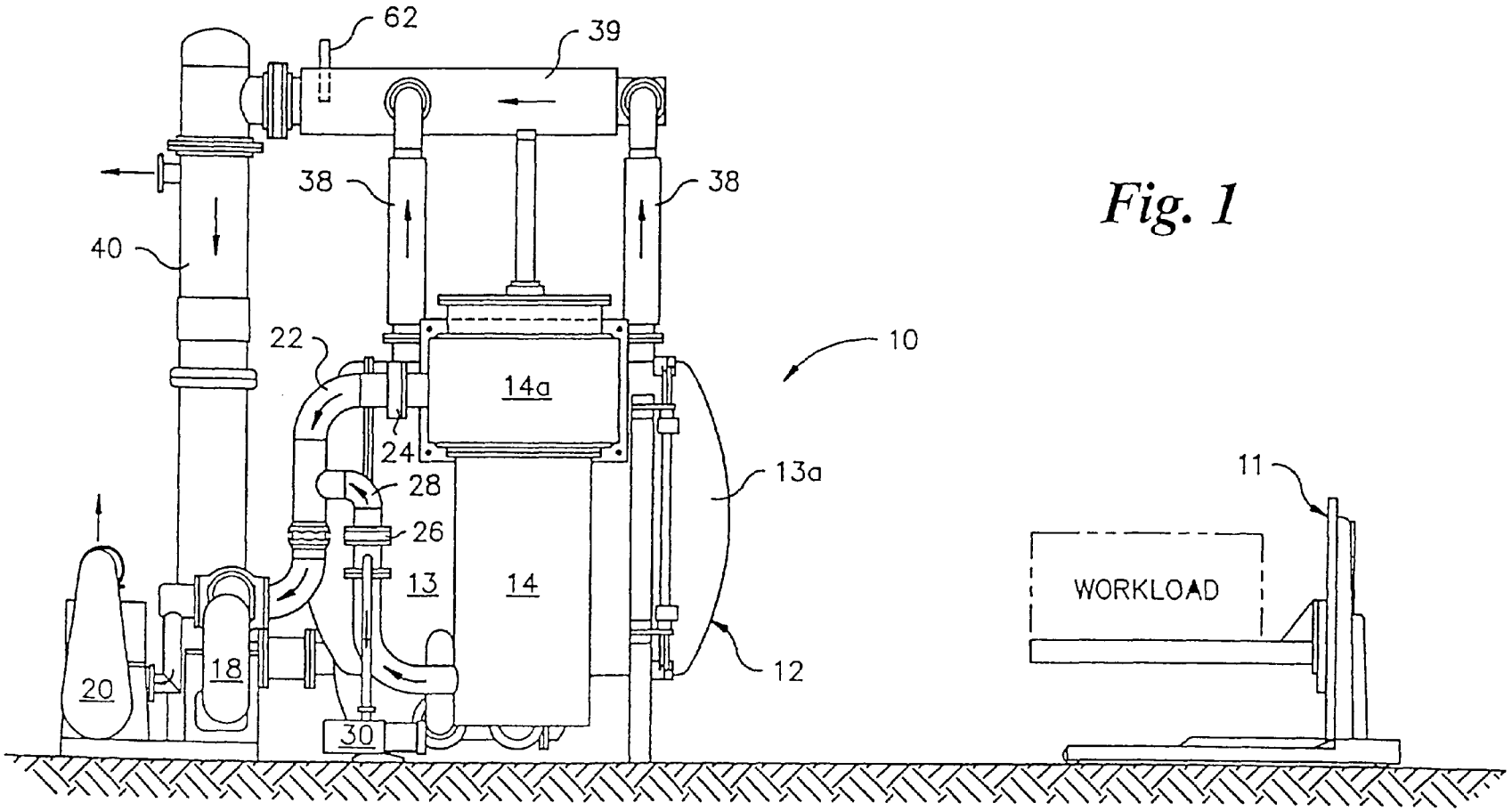
FIG. 1 represents a side elevation view of an electric resistance vacuum furnace and loader truck according to the invention for high temperature heat treatment of a workload.
Figure 2:
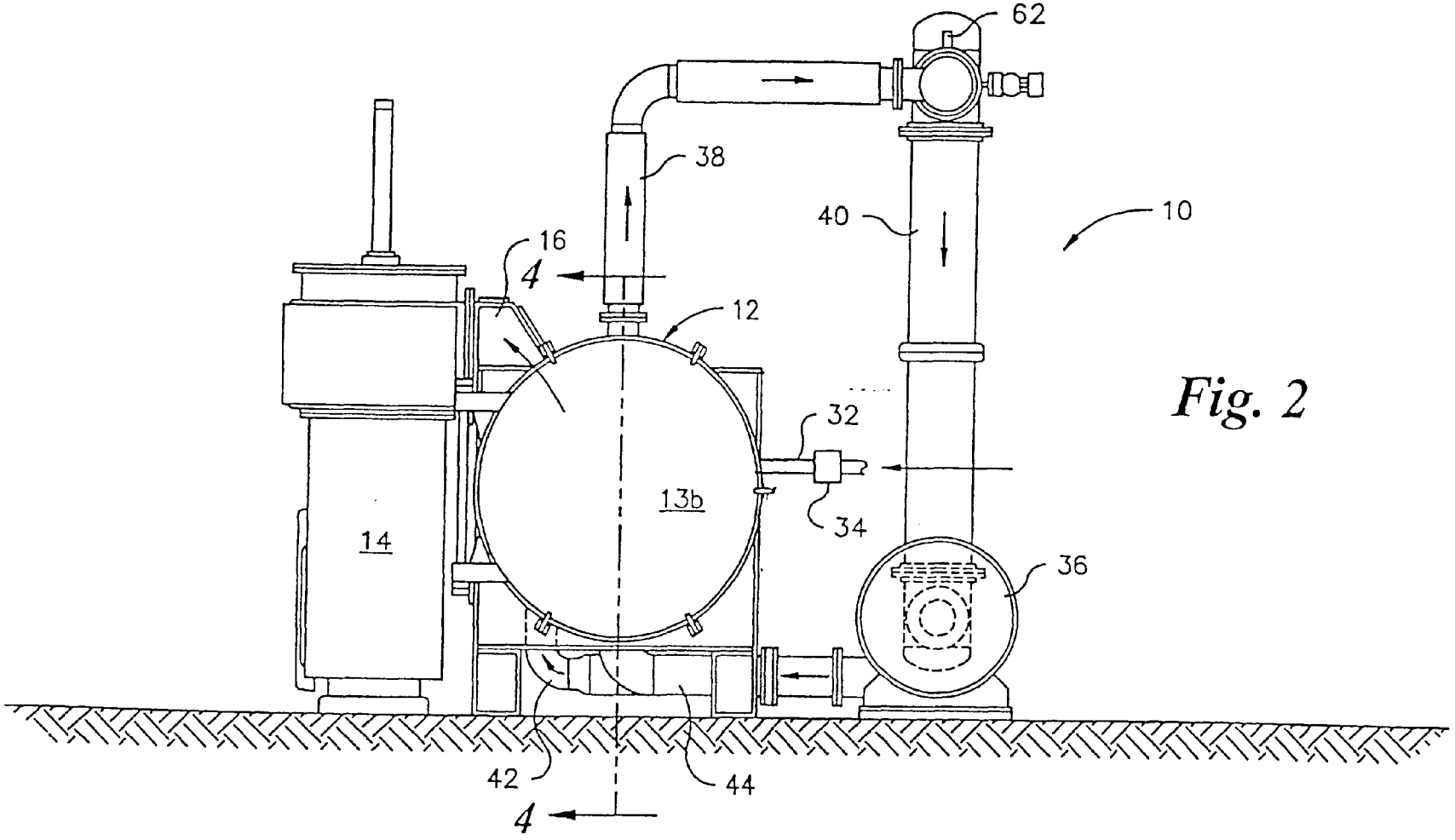
FIG. 2 represents a front view of the furnace of FIG. 1.
Figure 3A:
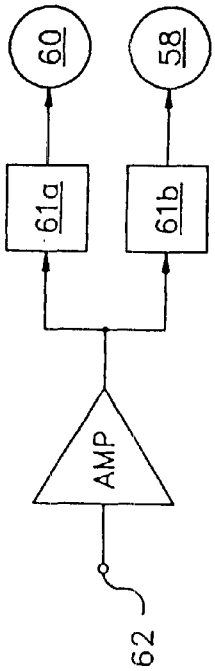
FIG. 3A is a functional block diagram according to the invention for automatic control of cooling fluid through the furnace.
Figure 3:
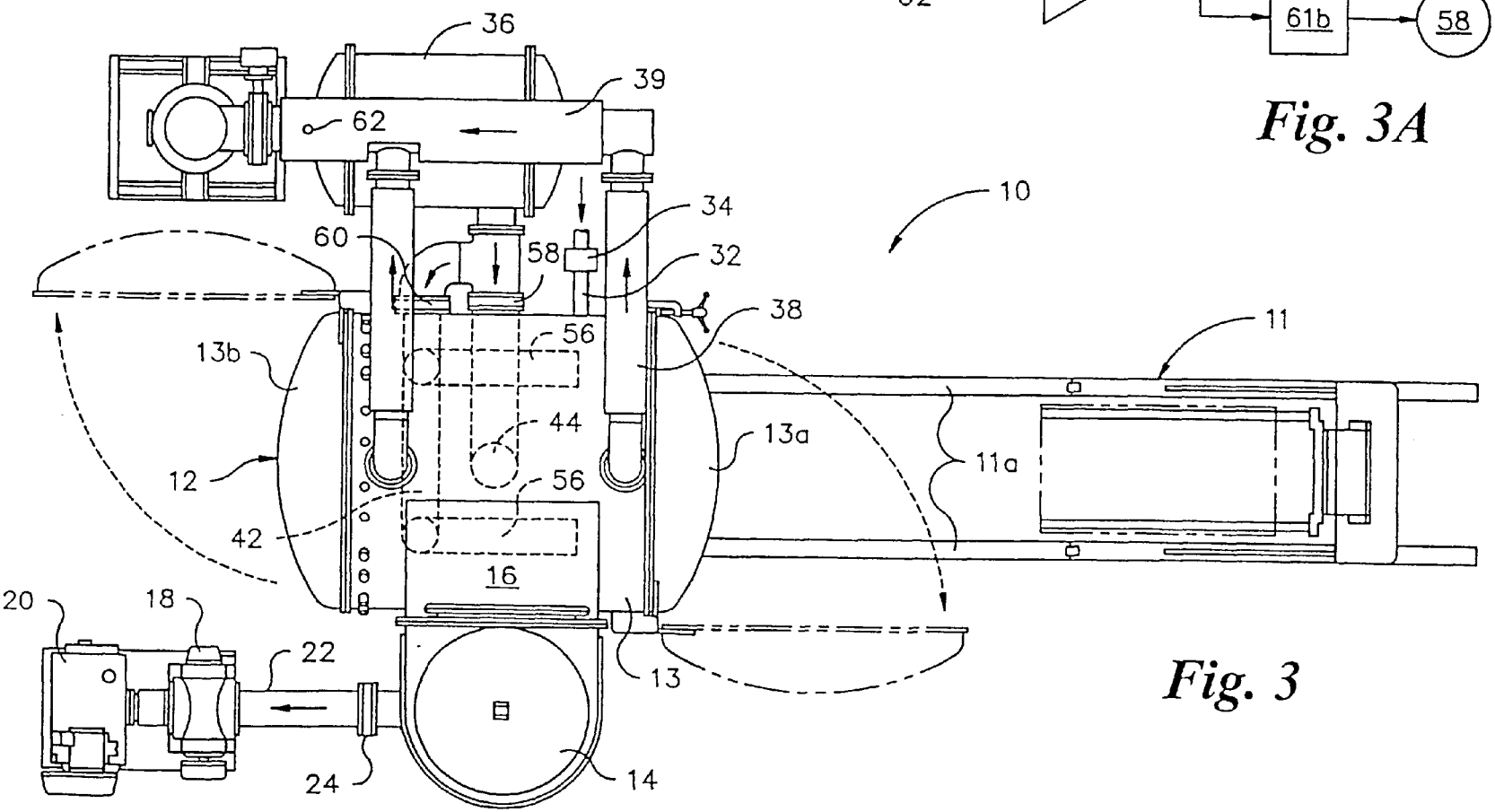
FIG. 3 represents a top view of the furnace and loader of FIG. 1.

Referring now to the drawings wherein like reference numbers or characters denote like or corresponding parts throughout the several views, FIGS. 1–3 show a high temperature vacuum heat treating system according to the invention indicated generally be the numeral 10 comprising a water-cooled electric vacuum furnace 12 for receiving a workload and a loader truck 11 on tracks 11*a* for positioning the workload therein. Furnace 12 includes a double-walled cylindrical vessel 13 closed at both ends by hinged double-walled front and rear loading doors 13*a* and 13*b* forming a vacuum-tight chamber. Cooling water is circulated between the double walls of vessel 13 and doors 13*a,* 13*b* by an exterior pump and heat exchanger not shown. A workload support is provided within the work space having three horizontal parallel rails 15 extending lengthwise and supported by axially spaced vertical rods 15*a* fixed to the bottom of vessel 13.

Vessel 13 is evacuated by a water-cooled oil diffusion pump 14, such as disclosed in U.S. Pat. No. 3,144,199 to Ipsen. An upper plenum high vacuum poppet valve 14*a* of a pump 14 communicates with a hot zone C through a rectangular duct 16 of low flow resistance on an upper side of vessel 13. Roughing pumps consisting of a vacuum blower 18 and mechanical pump 20 are connected in flow series to the plenum of diffusion pump 14 by a pipe 22 and a roughing valve 24, for evacuating the furnace from atmospheric pressure to an initial vacuum. Roughing valve 24 then closes and a foreline valve 26 in a pipe 28 opens connecting roughing pumps 18 and 20 to the diffusion pump 14. Poppet valve 14*a* also opens to lower the vacuum to the desired operating level. A hold pump 30 insures that a vacuum is maintained in diffusion pump 14 throughout the heat treating process.

Upon completing the heating and vacuum phases of the process, the workload is forced cooled by re-circulating an inert non-oxidizing fluid such as argon gas. The furnace vessel is initially backfilled with the fluid through a pipe 32 and shutoff valve 34. An outside blower 36 draws the fluid, heated as it passes through the furnace, into front and rear outlet pipes 38 and connecting pipe 39 to a heat exchanger 40. Fluid cooled by heat exchanger 40 returns to the furnace through inlet pipes 42 and 44.

Figure 4:
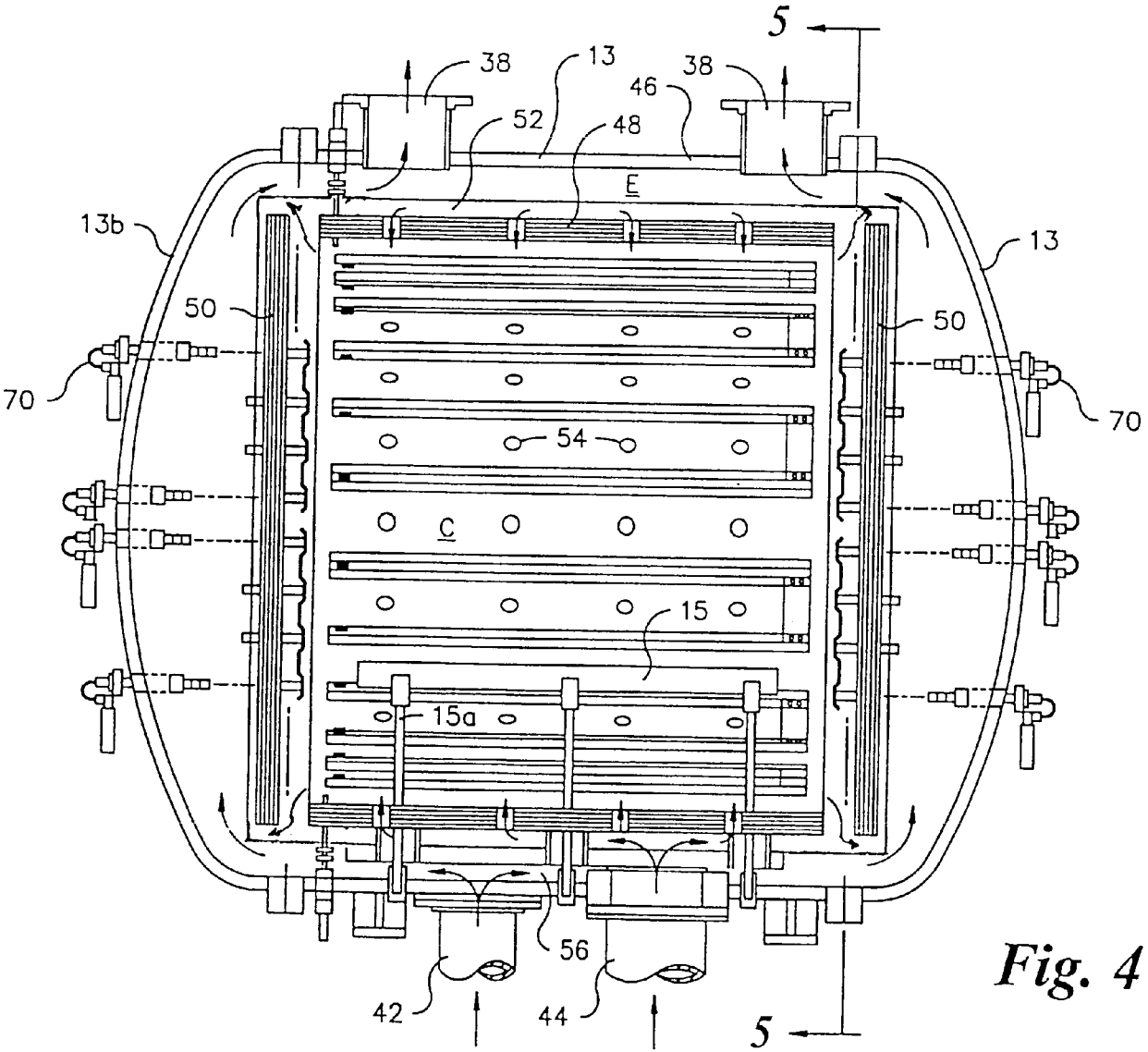
FIG. 4 is a view in longitudinal cross section of the furnace taken substantially in a vertical plane along the line 4—4 of FIG. 2.
Figure 5:
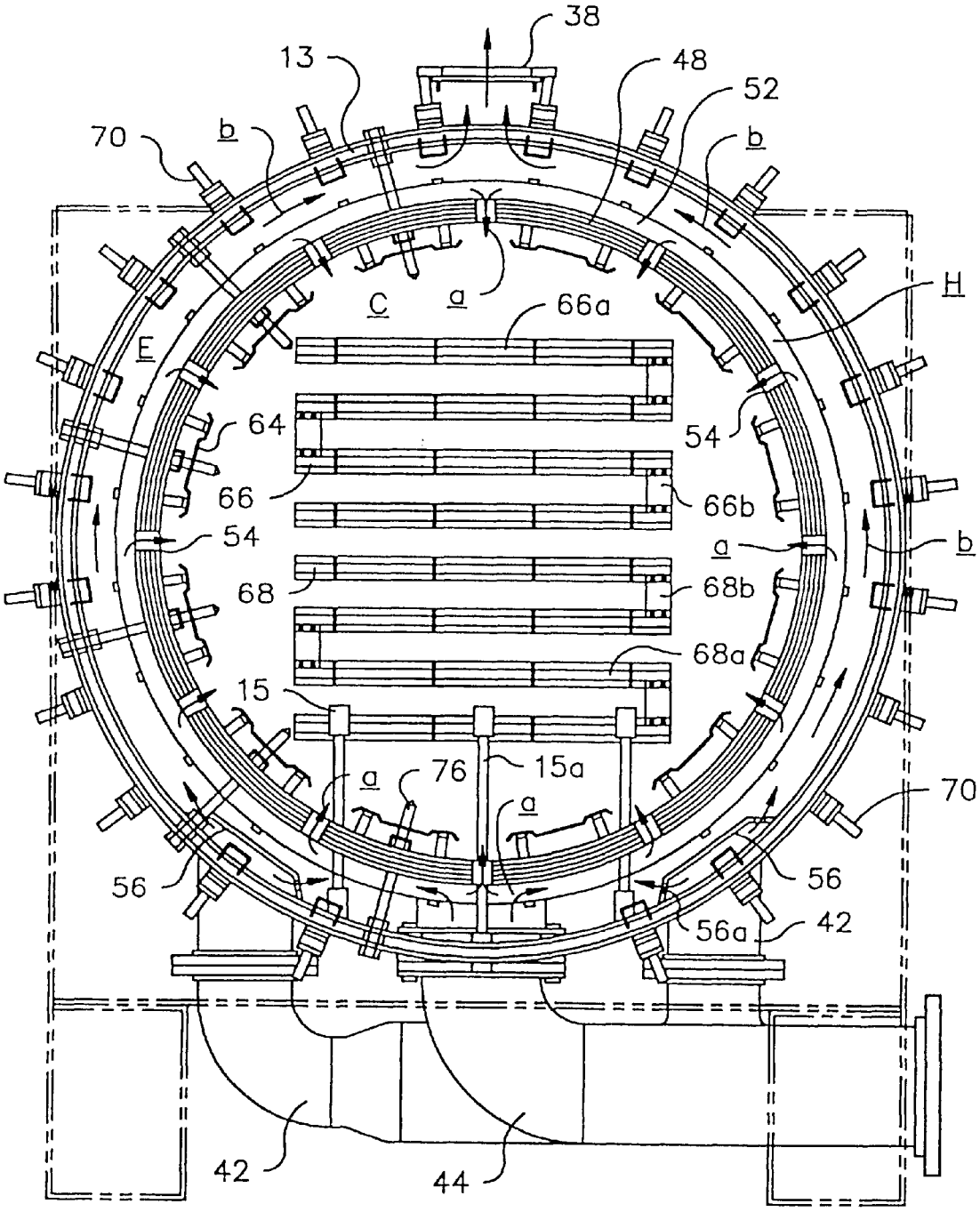
FIG. 5 is a view in transverse cross section of the furnace taken substantially in a vertical plane along the line 5—5 of FIG. 4.

Referring now to FIGS. 4 and 5, a radiant heat-reflecting assembly 48 of concentrically spaced cylindrical shields is offset mounted in vessel 13, and radiant heat-reflecting assemblies 50 of planar spaced shields are offset mounted on the interiors of front and rear doors 13*a* and 13*b* forming thereby an internal hot zone H consisting of an annular space occupied by a circular array of heating units 64, heat-reflecting, assembly 48 and a cylindrical plenum 52. In a furnace as constructed according to the invention by PV/T Inc. of Mount Laurel, N.J., heat-reflecting assemblies 48 and 50 are installed in vessel 13 having an inside diameter 54" and an inside length 66". Assemblies 48 and 50 are preferably constructed of a molybdenum-lanthanumoxide (ML) for superior creep resistance to sagging and resistance to re-crystallization at normal furnace operating temperatures. Plenum 52 surrounds assembly 48 and communicates with inlet pipe 44 to circulate the cooling fluid directly into hot zone H through a plurality of ports 54 in heat-reflecting assembly 48 to outlet pipes 38 as shown by arrows a in FIG. 4. Channels E formed between plenum 52 and vessel 13 and between end assemblies 50 and doors 13*a* and 13*b* provide cooling fluid bypasses via inlet pipe 42 feeding two parallel baffles 56 extending along the length of hot zone C. Holes 56*a* spaced along either side of baffles 56 disperse the fluid into channels E as shown by arrows b.

At the start of a cooling phase, a direct cooling valve 58 in inlet pipe 44 is closed and a bypass cooling valve 60 in inlet pipe 42 is opened to allow fluid to pass through channels E. Valves 58 and 60 are controlled by a valve regulators 61*a* & *b* (FIG. 3A) which is responsive to an amplified electrical signal from a temperature sensor 62 extending into connecting pipe 39. At temperatures above the safe operating limits of all seals and other temperature-sensitive components installed in the cooling fluid conduits, regulator 61 automatically positions valve 60 fully open while valve 58 remains filly closed. As the cooling fluid temperature in connecting pipe 39 begins to lower below the safe limit, regulator 61 proportionally modulates direct valve 58 toward opening and bypass valve 60 toward closing allowing the cooling fluid flow path to gradually shift from channels E to hot zone H. When valve 60 is completely closed, cooling continues through valve 58 until a desired temperature is reached for removing the workload. Regulator 61 may be of any well-known construction.

Figure 6:
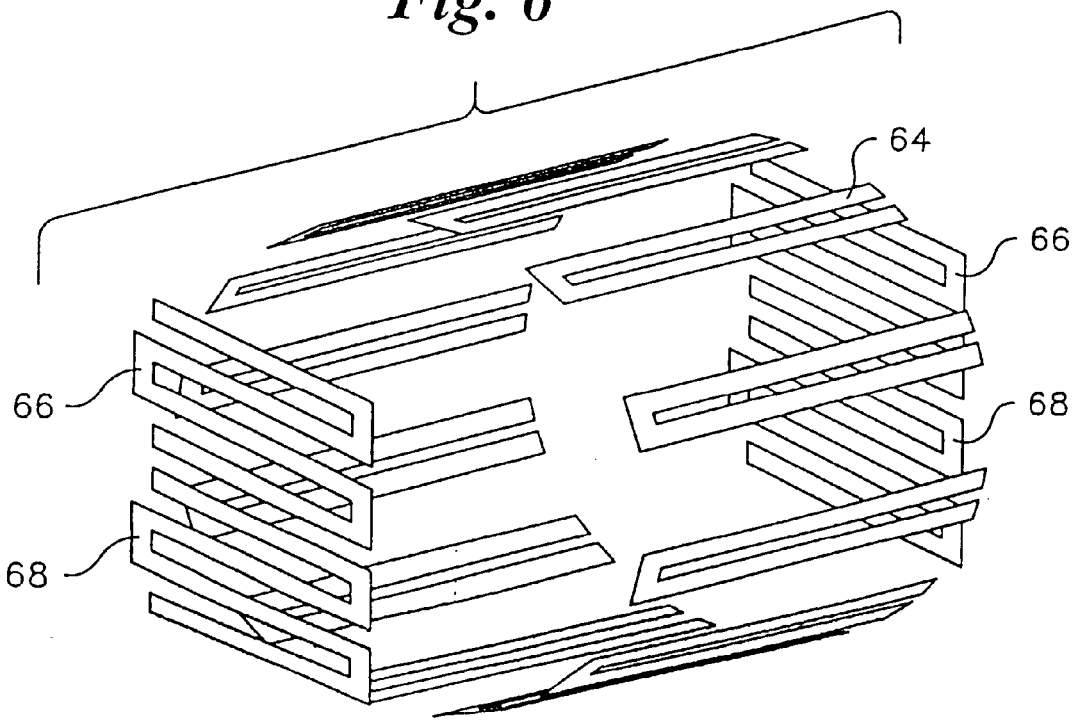
FIG. 6 is a schematic representation of an arrangement of electric radiant energy heating units according to the invention defining a hot zone in the furnace of FIG. 1.
Figure 7:
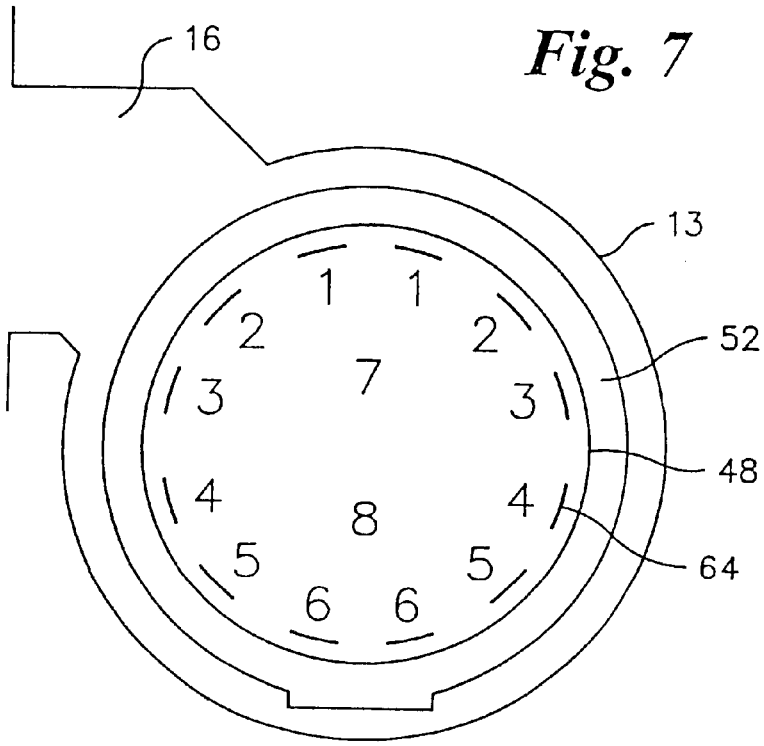
FIG. 7 is a diagram of the trim zones in the hot zones of FIG. 6.

Referring to FIGS. 4, 5 and 6, the furnace hot zone C is electrically heated by six pairs of elongate electrical radiant energy heating units 64 longitudinally offset from and uniformly spaced around the interior of assembly 48 by unit supports 65. The units of each pair are located on mutually opposed sides of assembly 48 to form six radial trim zones 1—1, 2—2, 3—3, 4—4, 5—5 and 6—6 as illustrated in FIG. 7. Two additional units 66 and 68 are offset in vertical planes from the interior of each of front and rear assemblies 50 to form two longitudinal trim zones 7—7 and 8—8 between the ends. For example, the region between circumferential locations 1—1 defines a first lateral trim zone, the region between circumferential locations 2—2 define a second lateral trim zone, etc. The regions between end locations 7—7 and 8—8 each define longitudinal trim zones. Of course the number of units and trim zones may vary according to user requirements. Electric terminals 70 extending from units 64, 66 and 68 through vessel 13 and doors 13*a*, 13*b* connect respectively to variable reactance transformers 71 (see FIGS. 11A, 11B), preferably mounted on top of furnace vessel 13, and are regulated in a manner describe hereinafter.

The more detailed views of FIGS. 8 and 9, show each unit 64 as having two parallel spaced elongate resistance elements 64*a* connected end-to-end in electrical series by a jumper plate 64*b*. Units 66 and 68 each include four parallel spaced elements 66*a* and 68*a*, respectively, connected end-to-end in electrical series by electrical resistance jumper plates 66*b* and 68*b*. All elements and jumper plates are preferably fabricated of a relatively thin ML alloy, but other refractory materials are contemplated including but not limited to compositions of tungsten, tantalum, pure nickel and nickel alloys, graphite and graphite composites. Elements 64*a*, 66*a* and 68*a* each has three thin flat lengthwise sections angularly disposed from each other to form a beam-like structure of low mass and relatively high section modulus for stiffness and resistance to sagging. Each element consists of a middle section for radiating energy directly into the work space, and opposed side sections for radiating energy directly in diverse directions into the work space. As can be seen in FIG. 9A, where solid lined arrows denote direct radiation and broken lined arrows denote reflected radiation, the angle a of each side section and the amount of offset d of units 64*a* from heat-reflecting assembly 48 to insure that substantially all the energy radiating from the backs of the side sections is reflected into hot zone C. An element 64*a* according to the invention, as installed in the furnace by PV/T Inc. supra, is made of stock ML 0.04" thick and ≈73.5"[1] long with middle and side sections each ≈1" wide. The side sections are inclined toward heat-reflecting assembly 48 with included angles α facing heat-reflecting assembly of 135°. To insure optimum reflection of the radiant energy, elements 64*a* are offset a distance d from heat shield assemblies 48 and 50 about two and one half times the width of an element flat section, i.e. ≈2½.

[1] The symbol ≈denotes approximately

FIG. 10 shows an end view of another configuration of a radiant energy heating unit wherein elements 67 have two lengthwise sides disposed relative to each other like an angle beam resulting in an element of low mass and a high modulus for stiffness and resistance to sagging. Like FIG. 9A, the radiation pattern of this configuration is illustrated in FIG. 10A. Energy from element 67 radiates directly into the work space in diverse directions, and the angle of the sections and amount of offset of the elements from assembly 48 insure that substantially all the energy radiating to heat-reflecting assembly 48 is reflected into hot zone C. An element 67 according to the invention as installed by PV/T Inc. in another furnace 12 is made of ML 0.04" thick, ≈73.5" long with each side section ≈2" wide. The side sections are inclined toward heat-reflecting assembly 48 when installed to form an included angle β facing the heat-reflecting assembly of ≈90°. To insure optimum reflection of the radiant energy elements 67 were offset a distance d from assemblies 48 and 50 about 1½ times the width of a section of element 67, i.e. ≈about 2½".

Figure 11A:
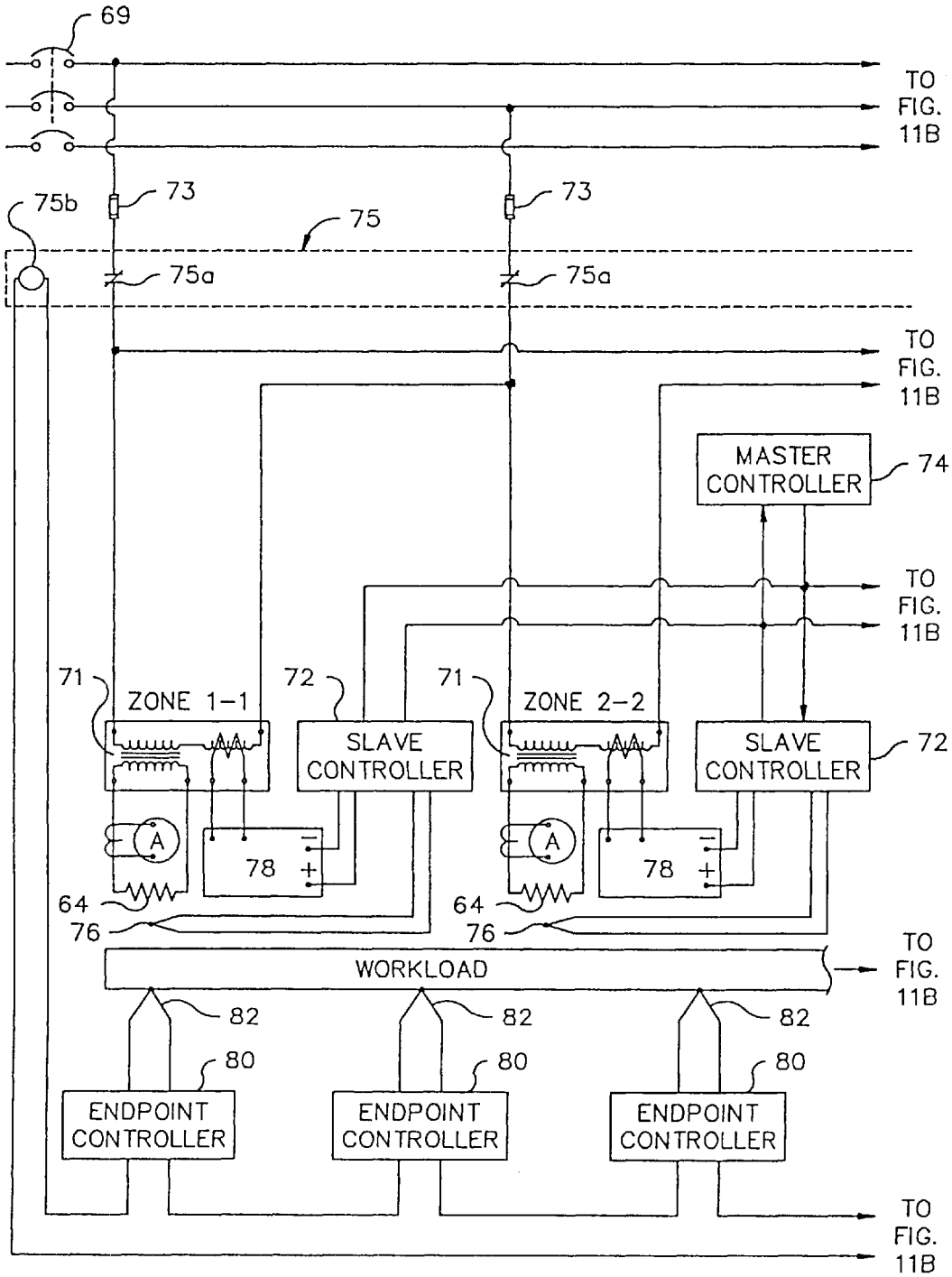
FIGS. 11A and 11B, taken together is an electrical circuit diagram according to the invention for automatic control of the heating units of FIG. 6.
Figure 11B:
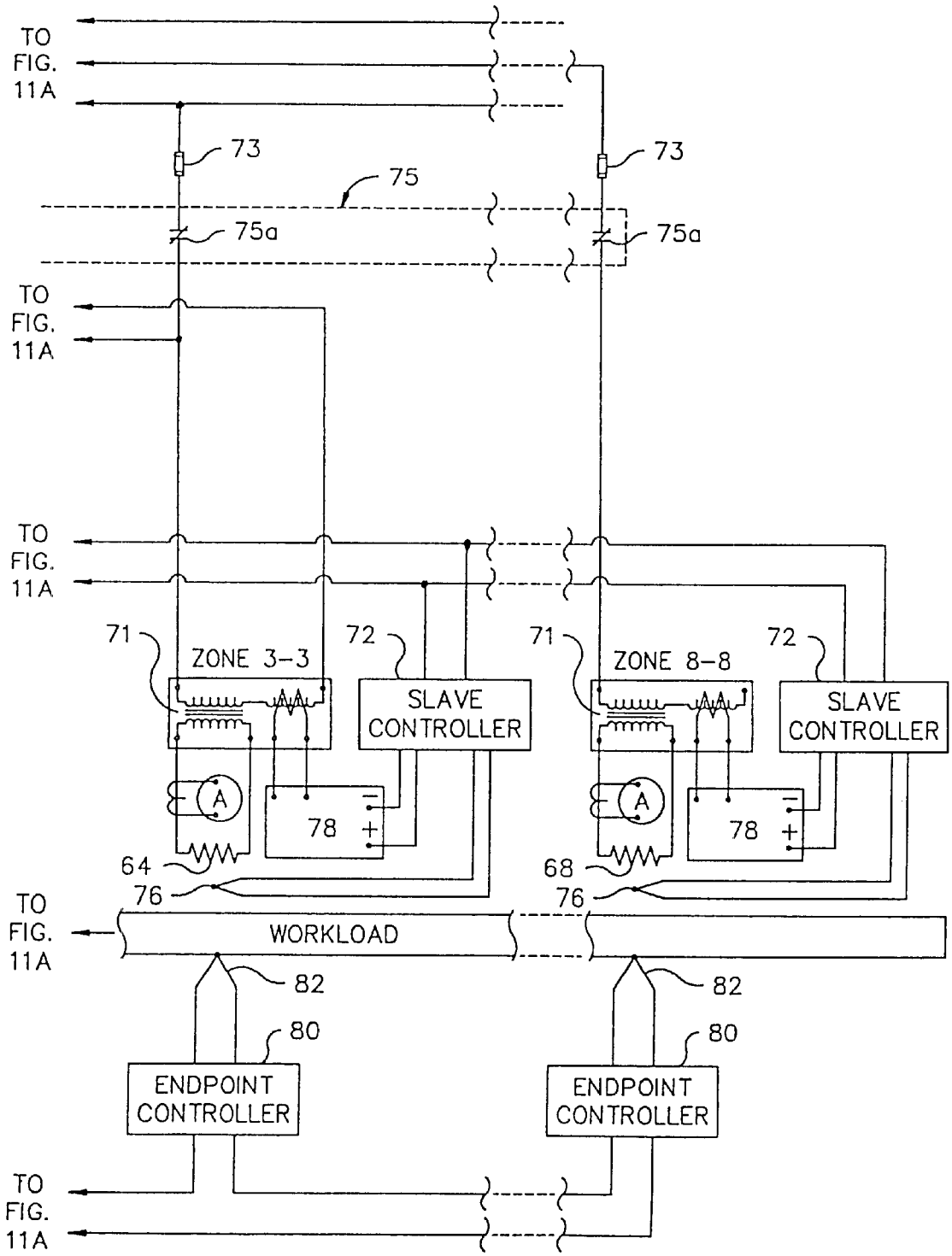

The temperature in each trim zones 1—1, 2—2, etc. in the work space is regulated throughout a furnace heating cycle by the electrical circuit schematically illustrated in FIGS. 11A and 11B. After an initial vacuum level is obtained by the vacuum pumps, a power switch 69 automatically starts the heating phase of the cycle by energizing a bank of reactance transformers 71 (FIG. 11A). Programmed cycle signals from a master controller 74 activate slave controllers 72 to increase the temperature as a function of time in the associated trim zones during a heat treating cycle. Responsive to the difference between the programmed signals and the temperature sensed by thermocouple 76 extending into hot zone C at the respective zones (FIG. 4), silicon controlled rectifiers 78 and transformers 71 regulate the current in the associated resistance elements 64, 66 and 68. End point controllers 80 receive signals indicative of the temperature of the workload from thermocouples 82 attached to or in close proximity thereto in each zone. The outputs of end point controllers 80 are connected in series with each other and with a coil 75*b* in relay 75 whereby contacts 75*a* open only when the preselected final temperatures of the workload in all zones are met. All controllers and heating units are then shut off thus completing the heating phase of the heat treating cycle.

Briefly summarizing the entire heat treating process by way of example, with a workload placed on support rails 15 in vessel 13 by loader truck 11, the doors are closed and roughing pumps 18 and 20 evacuate chamber C from atmospheric pressure (760 torr) to about 0.1 torr. Diffusion pump 14 then operates to further reduce the pressure to a high vacuum in the decade range of $10^{-5}$ torr and the heating phase begins. When all thermocouples 82 sense that the workload has reached a preset final end temperature of 1150° C., heating stops allowing the workload to slowly cool naturally to 1050° C. Vessel 13 is then backfilled with an argon gas from pipe 32 and forced cooling, starts with bypass cooling valve 60 opening fully while direct cooling valve 58 is closed. As the gas temperature from the furnace begins to drop the below a temperature corresponding to the maximum operating temperature limits of the seals and other exposed components in the cooling conduits, bypass valve 60 and direct valve 58 are modulated toward the closed and open positions, respectively, until the gas temperature reaches 150° C. whereupon forced cooling ends and atmospheric pressure is restored for removing the workload.

Some of the many advantages and novel features of the invention should now be readily apparent. For example, the electric vacuum heat treating furnace provides self-tuning temperature trim control in each zone to match the thermal mass of the workload. The furnace and workload can be rapidly cooled in a re-circulating cooling phase of the process without distortion of the workload or damage to any of the component parts of the furnace. Radiant heating resistance elements are of low mass and high section modulus to provide substantial stiffness and resistance to sagging when horizontally installed in the furnace. Clean high vacuum operating conditions are possible with heat applied in a very uniform and controlled manner for heat treating processes including brazing, tempering, degassing, sintering and hardening. The heating elements will efficiently disperse radiant energy from substantially all surfaces of the elements to a workload. Re-circulation of cooling fluid is regulated after completing the heating phase of the process to prevent exposed temperature sensitive components from exceeding their designed limits. The furnace construction meets the severe demands of industry for precise vertical and horizontal temperature trim control during the heat treating process.

Various changes in details, steps and arrangement of parts, which have been herein described and illustrated in order to explain the nature of the invention, may be made by those skilled in the art within the principles and scope of the invention as expressed in the claims appended hereto.

What is claimed is:

1. An improved radiant heating apparatus for an electric vacuum heat treating furnace, the improvement comprising:

an elongate radiant heat reflecting shield for surrounding a work load;

a plurality of elongate parallel-spaced radiant heating elements offset from said shield and in lengthwise alignment with said shield, each of said elements having a flat section contiguously connected flat sections disposed from each other for radiating energy in diverse directions; and a jumper plate connecting said elements at mutually adjacent one ends thereof in electrical series.

2. An improved radiant heating apparatus for an electric vacuum heat treating furnace, the improvement comprising:

a radiant heat reflecting shield for surrounding a work load;

a plurality of elongate parallel-spaced radiant heating elements offset from said shield, each of said elements having contiguously connected flat sections angularly disposed from each other, said elements defining a middle section and opposed side sections, each of said side sections forming with said middle section an included angle facing the shield; and a jumper plate connecting said elements at mutually adjacent one ends thereof in electrical series.

3. The improvement of claim 2 wherein said elements are offset from said shield to effect optimum direct and reflected energy to the work load.

4. The improvement of claim 1 wherein each of said elements define two sections with an included angle facing said shield.

5. The improvement of claim 4 wherein said elements are offset from said shield a distance to effect optimum direct and reflected energy to the work load.

6. Apparatus for heat treating a work load with radiant energy, comprising:

a furnace vessel having an elongate heat reflective shield formed to receive the work load; and elongate electrically resistive elements offset from and parallel-spaced around the interior of said shield in lengthwise alignment with said shield, each of said elements having flat sections contiguously connected lengthwise and angularly disposed from each other to form an included angle facing said shield;

whereby energy from said elements and said shield radiates in diverse directions to the work load.

7. The apparatus of claim 6 wherein said sections define two sections of substantially equal width.

8. Apparatus for heat treating a work load with radiant energy, comprising:

a furnace vessel having a heat reflective shield formed to receive the work load; and elongate electrically resistive elements offset from and parallel-spaced around the interior of said shield, said elements each define in cross section angularly disposed flat sections forming an included angle facing said shield, each of said elements comprises a middle section and two opposed side sections respectively forming included angles with said middle section;

whereby energy from said elements and said shield radiates in diverse directions to the work load.

9. The apparatus of claim 8 wherein said sections are of substantially equal widths and said included angles are substantially equal.

10. The apparatus of claim 8 wherein each of said sections is about one inch wide and each included angle is about 135 degrees.

* * * * *